US007559810B1

(12) United States Patent
Wu

(10) Patent No.: US 7,559,810 B1
(45) Date of Patent: Jul. 14, 2009

(54) TERMINAL BLOCK STRUCTURE

(76) Inventor: Shang Tsai Wu, No. 3, Min An Road, Hsin Chuang, 242 Taipei Hsien (TW)

( * ) Notice: Subject to any disclaimer, the term of this patent is extended or adjusted under 35 U.S.C. 154(b) by 0 days.

(21) Appl. No.: 12/265,252

(22) Filed: Nov. 5, 2008

(51) Int. Cl.
*H01R 4/30* (2006.01)

(52) U.S. Cl. ..... 439/801; 439/709

(58) Field of Classification Search ..... 439/444, 439/709, 781, 782, 801, 815
See application file for complete search history.

(56) References Cited

U.S. PATENT DOCUMENTS 3,800,269 A * 3/1974 Palombella ..... 439/712
4,040,700 A * 8/1977 Obuch ..... 439/431
4,180,305 A * 12/1979 Ustin et al. ..... 439/717
4,361,371 A * 11/1982 Williams ..... 439/76.1
4,630,882 A * 12/1986 Naylor et al. ..... 439/444
4,881,903 A * 11/1989 Tsuji ..... 439/76.1
5,595,505 A * 1/1997 Duke et al. ..... 439/630
6,176,747 B1 * 1/2001 Rowe et al. ..... 439/721

* cited by examiner

*Primary Examiner*—Thanh-Tam T Le
(74) *Attorney, Agent, or Firm*—Birch, Stewart, Kolasch & Birch, LLP

(57) ABSTRACT

Provided is a terminal block structure which includes a base. The base is provided with one or more terminal recesses thereabove. Inside the terminal recess are a holder and an inverted U-shaped nut. The holder and the inverted U-shaped nut mate and engage with each other, and have to be inserted into the terminal recess by a force. The square shape of the inverted U-shaped nut has a retaining effect on the inverted U-shaped nut positioned inside the terminal recess. Hence, a fastener (a screw or a bolt) penetrating the holder and the inverted U-shaped nut and thereby fixing the holder and the inverted U-shaped nut in position is mechanically counteracted by the inverted U-shaped nut, and thus the holder and the inverted U-shaped nut are unlikely to be released from the terminal recess.

6 Claims, 9 Drawing Sheets

TERMINAL BLOCK STRUCTURE

BACKGROUND OF THE INVENTION

1. Field of the Invention

The present invention relates to a terminal block structure unlikely to loosen and easy to assemble.

2. Description of the Prior Art

Terminal blocks are widely used in implementation of electrical signal transmission and electrical connection. FIG. 7 shows a conventional terminal block structure which includes a base 80. The base 80 is provided with one or more terminal recesses 81 thereabove. A retaining socket 82 is provided at the middle of the terminal recess 81. The retaining socket 82 is substantially hexagonal in shape and is configured to receive a nut 70 therein (seeing FIG. 8). Referring to FIG. 7, a holder 60 is disposed inside the terminal recess 81. A platform 61 is formed on the top surface of the holder 60, and is centrally formed with a through hole 62. The holder 60 is flanked by two inserts 63 provided with a barb each. The holder 60 is inserted into the terminal recess 81 by a force and is stopped when the inserts 63 abut against the inner wall of the terminal recess 81, and in consequence the holder 60 is fixed in position and cannot be released from the terminal recess 81. A terminal pin 64 configured to facilitate electrical signal transmission is provided at the end of one of the inserts 63 of the holder 60.

A fastener 50, which may be a screw or a bolt, has a stud provided with a pad 51 thereabove. A clamping surface against which a terminal head (not shown) abuts is defined between the pad 51 and the platform 61 of the holder 60. The fastener 50 penetrates the through hole 62 of the holder 60, and is screwed to the nut 70. In so doing, a terminal block structure is finalized.

However, in practice, the fastener 50 tends to rotate and loosen and thereby allows the nut 70 to be released from the retaining socket 82; as a result, loosening of the fastener 50 often follows second screwing. The defect renders an assembly process difficult, and is a major drawback of the prior art.

Also, the retaining socket 82 is fabricated by trenching in another recess, and thus the fabrication process of the retaining socket 82 is time-consuming and laborious. Furthermore, the retaining socket 82 is too shallow to hold the nut 70 firmly, and in consequence the nut 70 tends to loosen. The above-mentioned fact represents another drawback of the prior art.

Referring to FIG. 9, in addition to the base 80 shown in FIG. 7, another conventional terminal block structure comprises a holder 90 centrally formed with a screw hole 91 configured to replace known said base 80 shown in FIG. 7. The design is seemingly good in that it dispenses with a component required for the prior art, but in practice the design has a flaw. That is, to form the screw hole 91 in the holder 90, the holder 90 must be made from brass (alloy of copper and zinc). From the perspective of material science, brass has its own drawbacks. Pure copper cannot be tapped to form the screw hole 91 with expected efficacy. The above-mentioned fact represents a further drawback of the prior art.

Yet a further drawback of the prior art is described below. Where the holder 90 has an additional purpose, namely, serving as a nut, the holder 90 has to bear a screwing force. The resultant problem is that, a terminal pin which is indispensable to the holder 90 bears the screwing force directly and therefore is likely to bend or crack, and in consequence contacts between the terminal pin and solder are vulnerable.

SUMMARY OF THE INVENTION

It is the primary objective of the present invention to provide a terminal block structure comprising a holder and an inverted U-shaped nut beneath the holder, enable the holder and the inverted U-shaped nut to mate and engage with each other, and dispose the inverted U-shaped nut in a terminal recess, which, together with the inverted U-shaped nut assuming a substantially square shape, prevents the nut from loosening, and solves all the aforesaid drawbacks of the prior art.

To achieve the aforesaid objective, the present invention is implemented as follows:

A terminal block structure, comprising: a base provided with at least a terminal recess thereon; a holder disposed inside the terminal recess, having a top surface formed with a platform centrally provided with a through hole, and flanked by two inserts each provided with an engagement portion thereon, wherein one of the inserts is terminally provided with a terminal pin; an inverted U-shaped nut having a top portion formed with a threaded through hole therein, flanked by two wings each provided with an engagement portion corresponding in position to a corresponding one of the inserts, and disposed beneath the holder, wherein the engagement portions of the inverted U-shaped nut are configured to mate and engage with the engagement portions of the holder so as to prevent rotation thereof, and a fastener being a screw or a bolt configured to penetrate the holder and the inverted U-shaped nut and thereby enable the holder and the inverted U-shaped nut to be fixed in position.

BRIEF DESCRIPTION OF THE DRAWINGS

The invention as well as a preferred mode of use, further objectives and advantages thereof, will best be understood by reference to the following detailed description of illustrative embodiments when read in conjunction with the accompanying drawings, wherein.

DETAILED DESCRIPTION OF THE EMBODIMENTS

Figure 1:
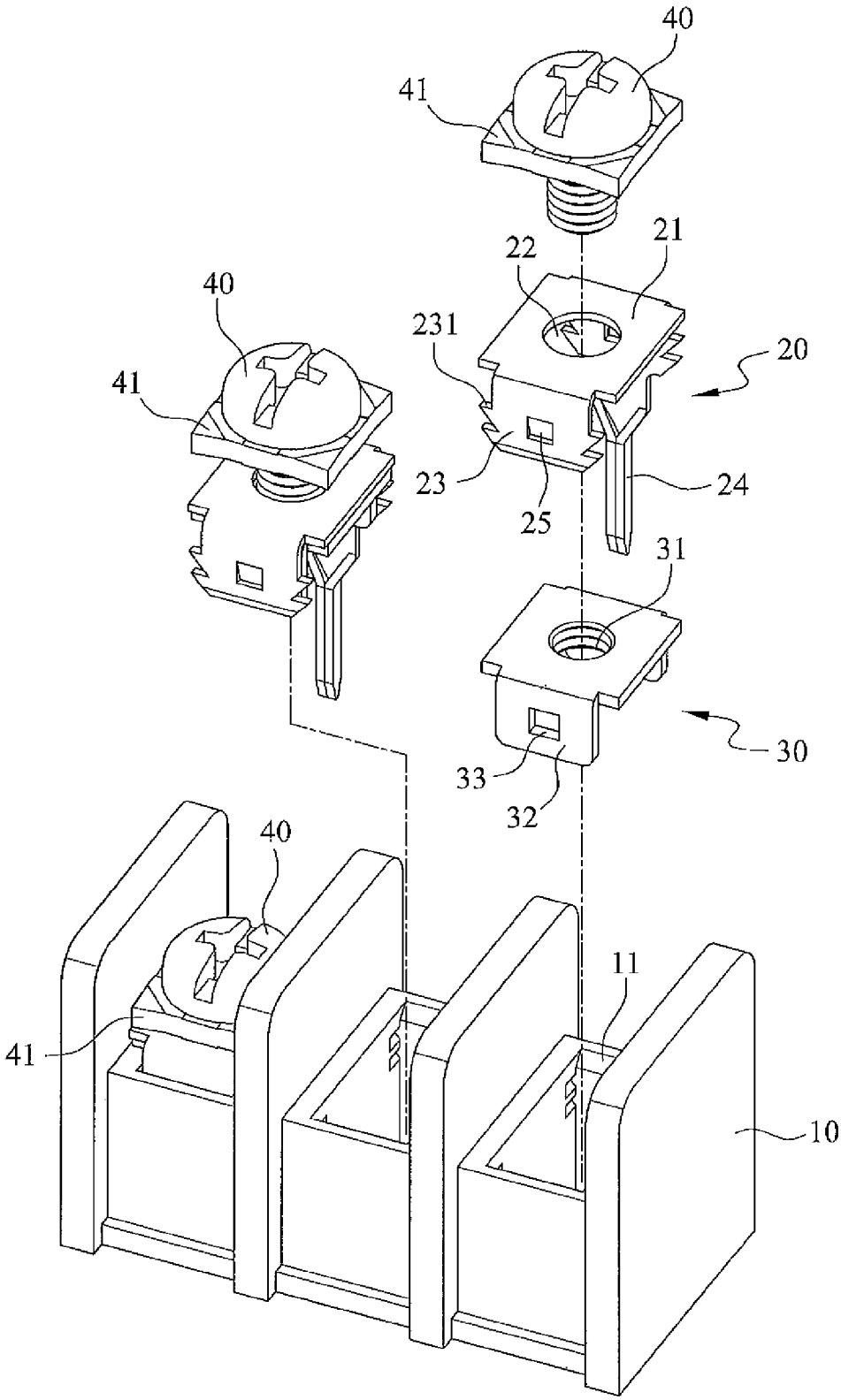
FIG. 1 is a partial exploded view of the present invention.
Figure 2:
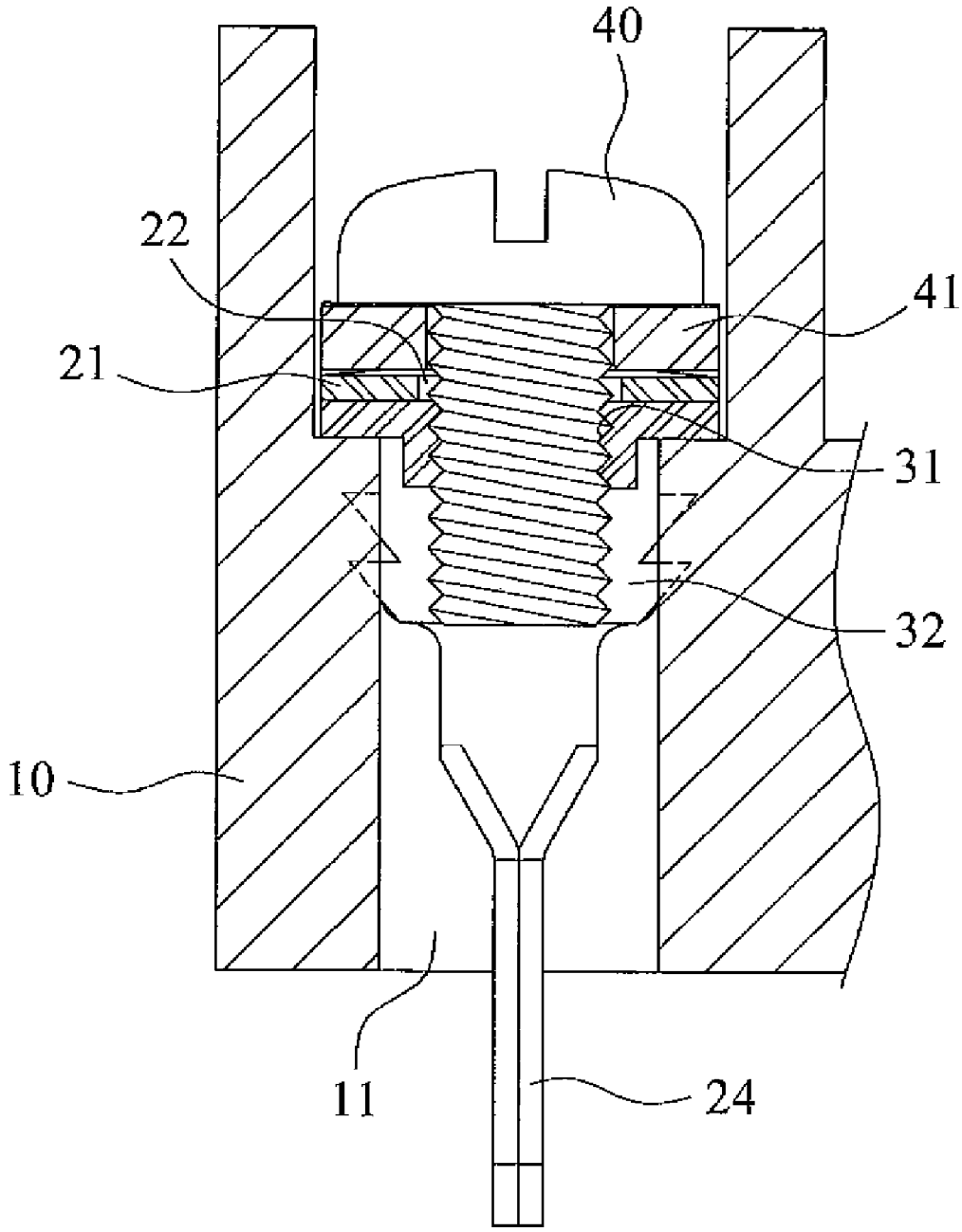
FIG. 2 is a cross-sectional front view taken along line x-x according to the present invention.

Referring to FIGS. 1, 2, 3 and 4, a terminal block of the present invention comprises the following components.

A base 10 is provided with one or more terminal recesses 11 thereon. The present invention is exemplified by three said terminal recesses 11 shown in the drawings of the present invention.

One or more holders 20 are disposed inside the terminal recesses 11. A platform 21 is formed on the top surface of the holder 20. A through hole 22 is centrally formed on the platform 21. The holder 20 is flanked by two inserts 23 equipped with a barb 231 each. Each of the inserts 23 is provided with an engagement portion 25 thereon. The engagement portion 25 is a tenon (shown in FIGS. 1 and 3) formed by punching or a slot mortise (shown in FIG. 5, to be described below). The holder 20 is inserted into the terminal recess 11 by a force and is stopped when the inserts 23 abut against the inner wall of the terminal recess 11. The barbs 231 pierce the inner wall of the terminal recess 11 so as to prevent the holder 20 from loosening. A terminal pin 24 configured to facilitate electrical signal transmission is provided at the end of each of the inserts 23.

Figure 3:
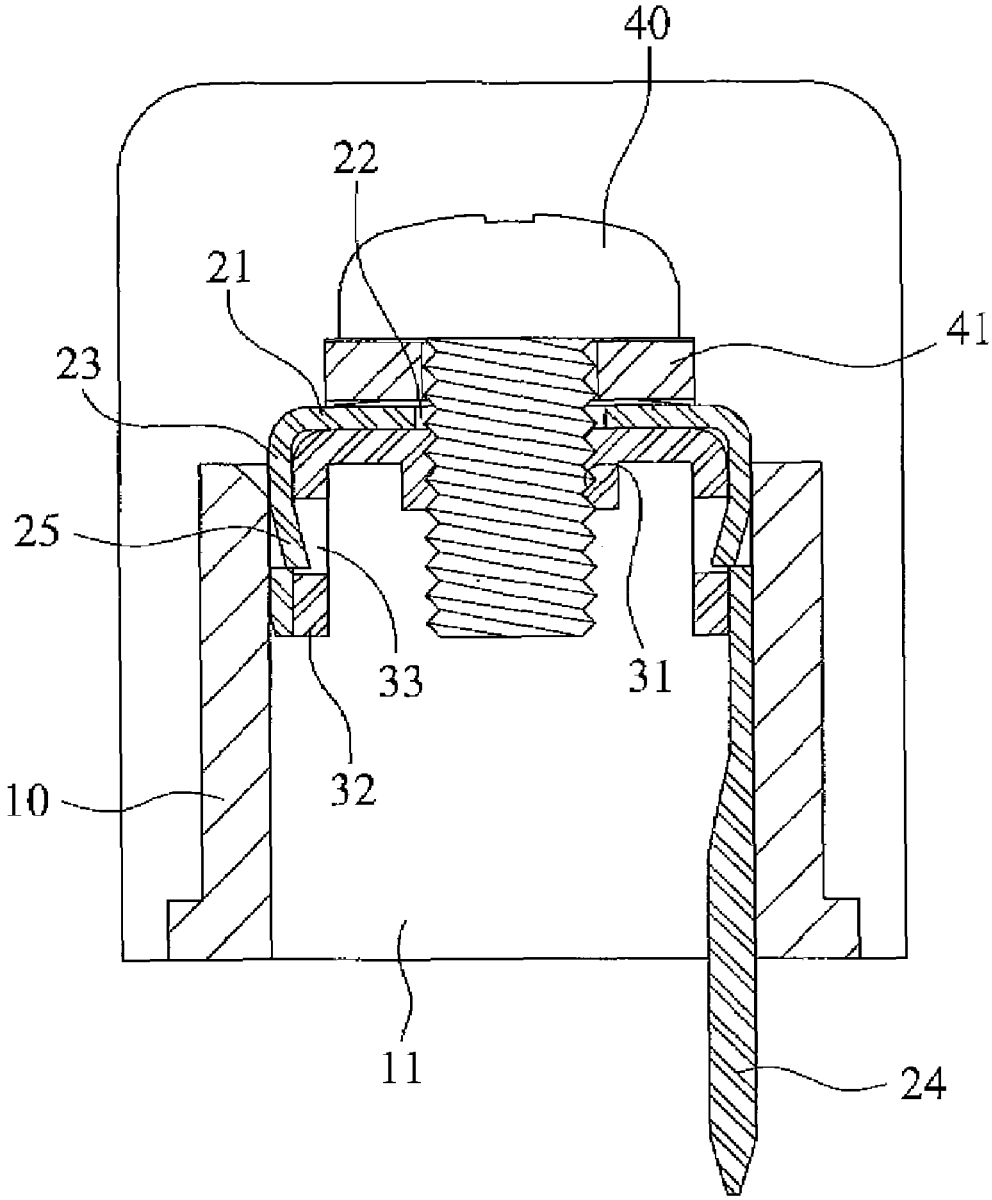
FIG. 3 is a cross-sectional side view taken along line y-y according to the present invention.
Figure 4:
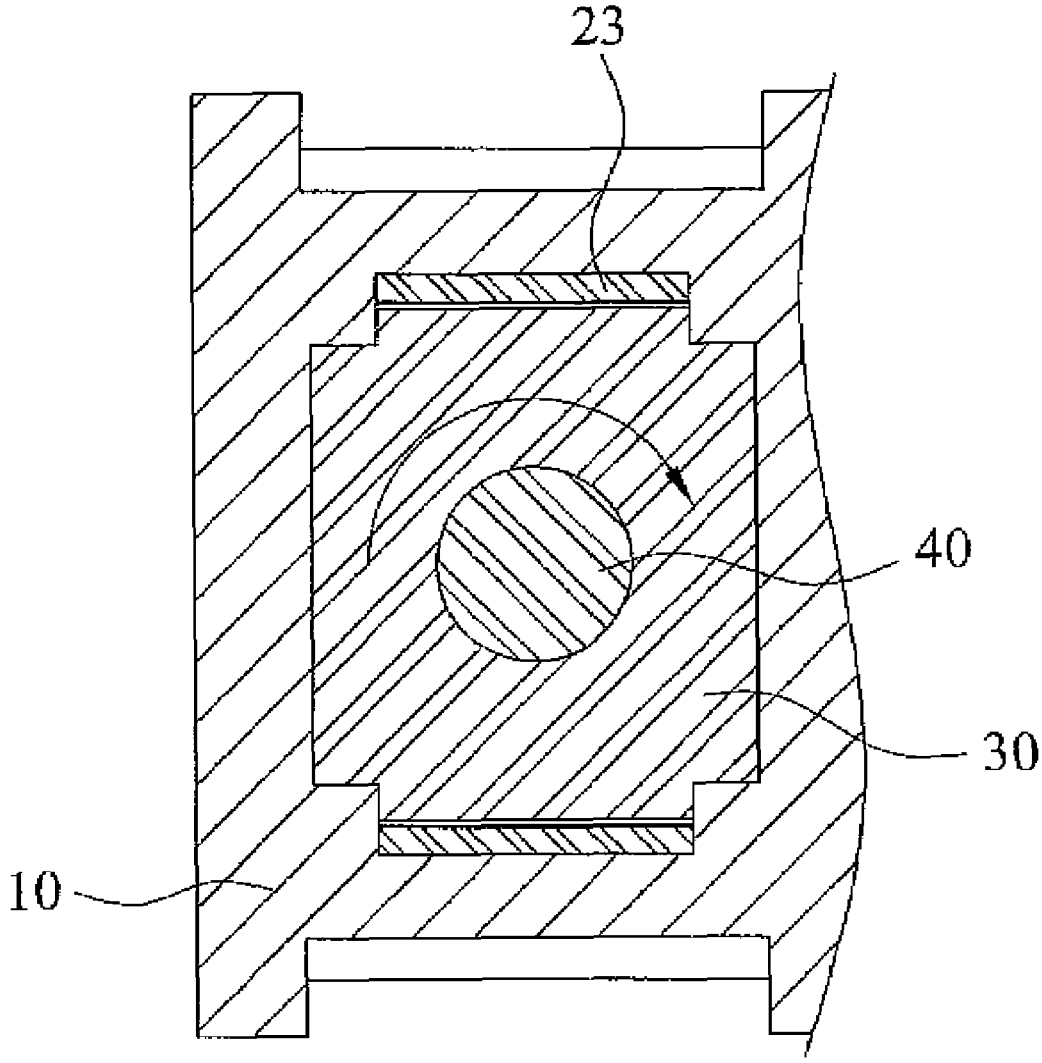
FIG. 4 is a cross-sectional top view taken along line z-z according to the present invention.

An inverted U-shaped nut 30 has a top portion formed with a through hole 31 therein. The through hole 31 is threaded. The inverted U-shaped nut 30 is flanked by two wings 32. The wings 32 are each provided with an engagement portion 33 corresponding in position to a corresponding one of the inserts 23 of the holder 20. The engagement portions 33 are slot mortises as shown in FIGS. 1 and 3. The inverted U-shaped nut 30 is disposed beneath the holder 20. The engagement portions 25, 33 of the holder 20 and the inverted U-shaped nut 30 are configured to mate and engage with each other so as to prevent rotation thereof.

A fastener 40, which is a screw or a bolt, has a stud provided with a pad 41 above. A clamping surface against which a terminal head (not shown) abuts is defined between the pad 41 and the platform 21 of the holder 20. The fastener 40 penetrates the through hole 22 of the holder 20 so as to be screwed to the threaded through hole 31 of the inverted U-shaped nut 30.

In practice, the holder 20 and the inverted U-shaped nut 30 are fixed in position relative to each other by means of the engagement portions 25, 33, and are disposed inside the terminal recess 11 together. In the aforesaid preferred embodiment, the holder 20 is fixed in position inside the terminal recess 11 by means of the inserts 23 equipped with the barbs 231. Owing to the substantially square shape of the inverted U-shaped nut 30 and the holder 20, the inverted U-shaped nut 30 and the holder 20 are held firmly inside the terminal recess 11 and therefore are unlikely to be released from the terminal recess 11, which is otherwise the case in the prior art. With the fastener 40 exerting a force on the inverted U-shaped nut 30 only, the holder 20 is invulnerable. The features are the major advantages of the present invention.

Figure 5:
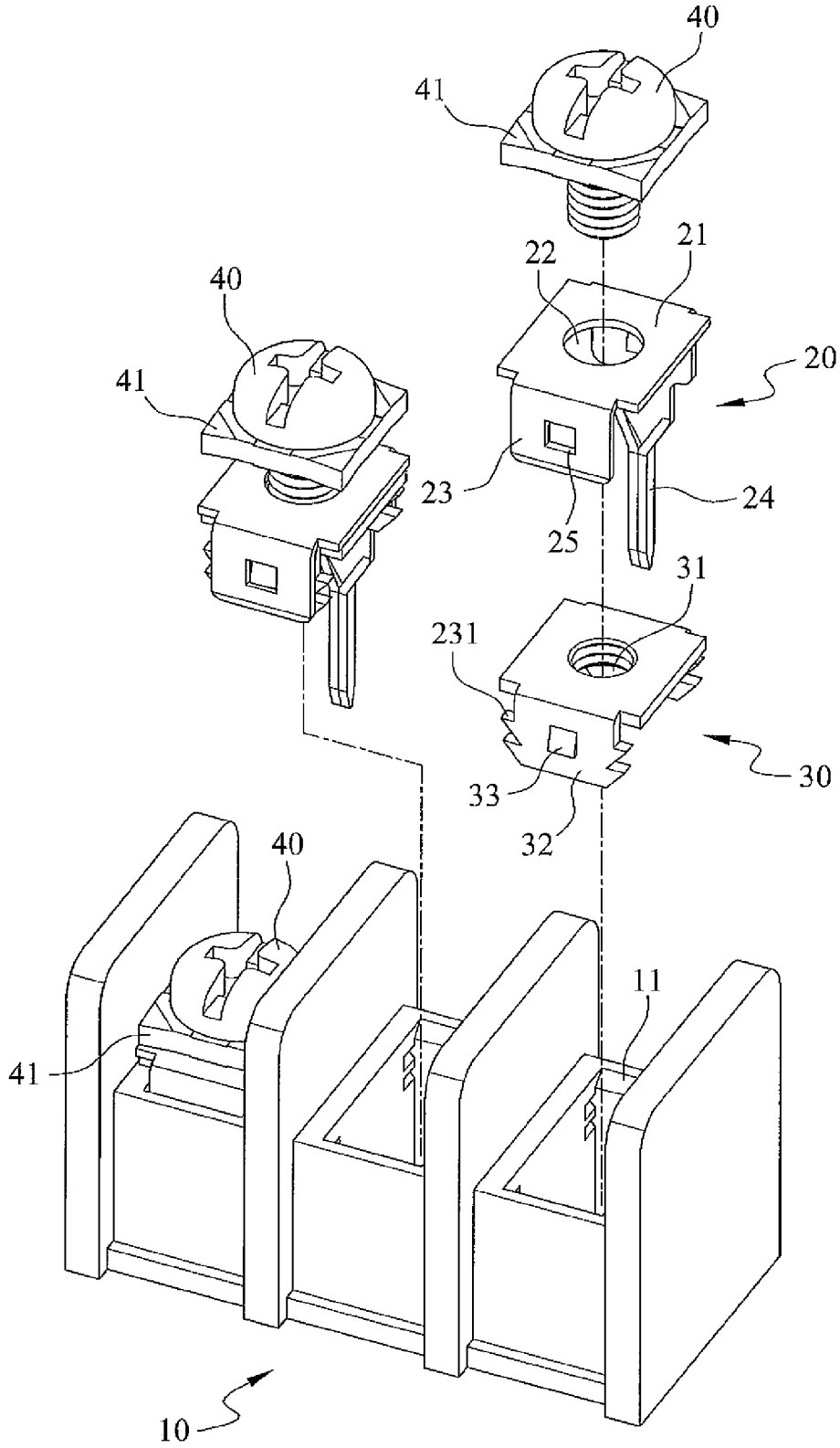
FIG. 5 is a schematic view of a preferred embodiment of the present invention.
Figure 6:
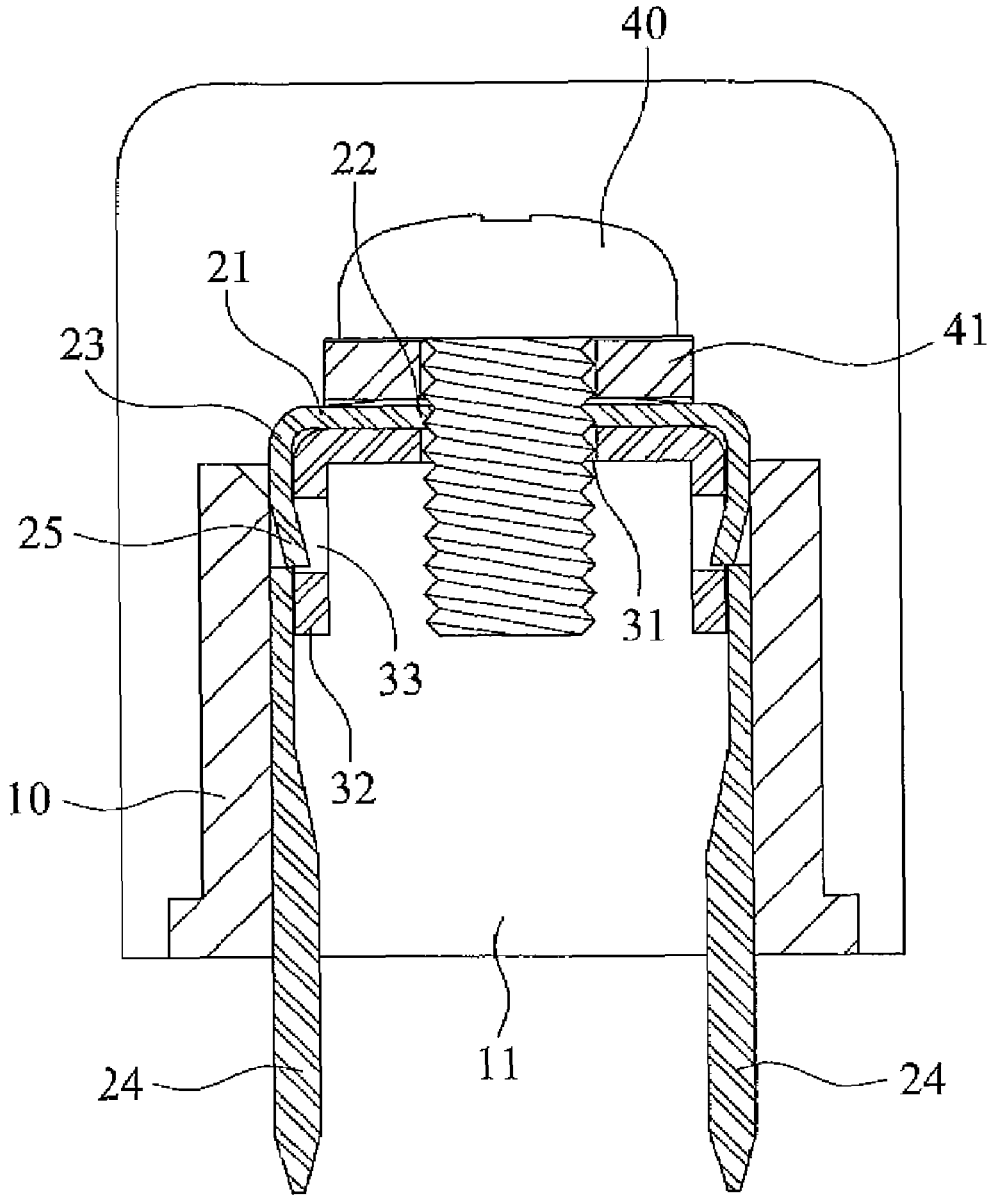
FIG. 6 is a schematic view of another preferred embodiment of the present invention.
Figure 7:
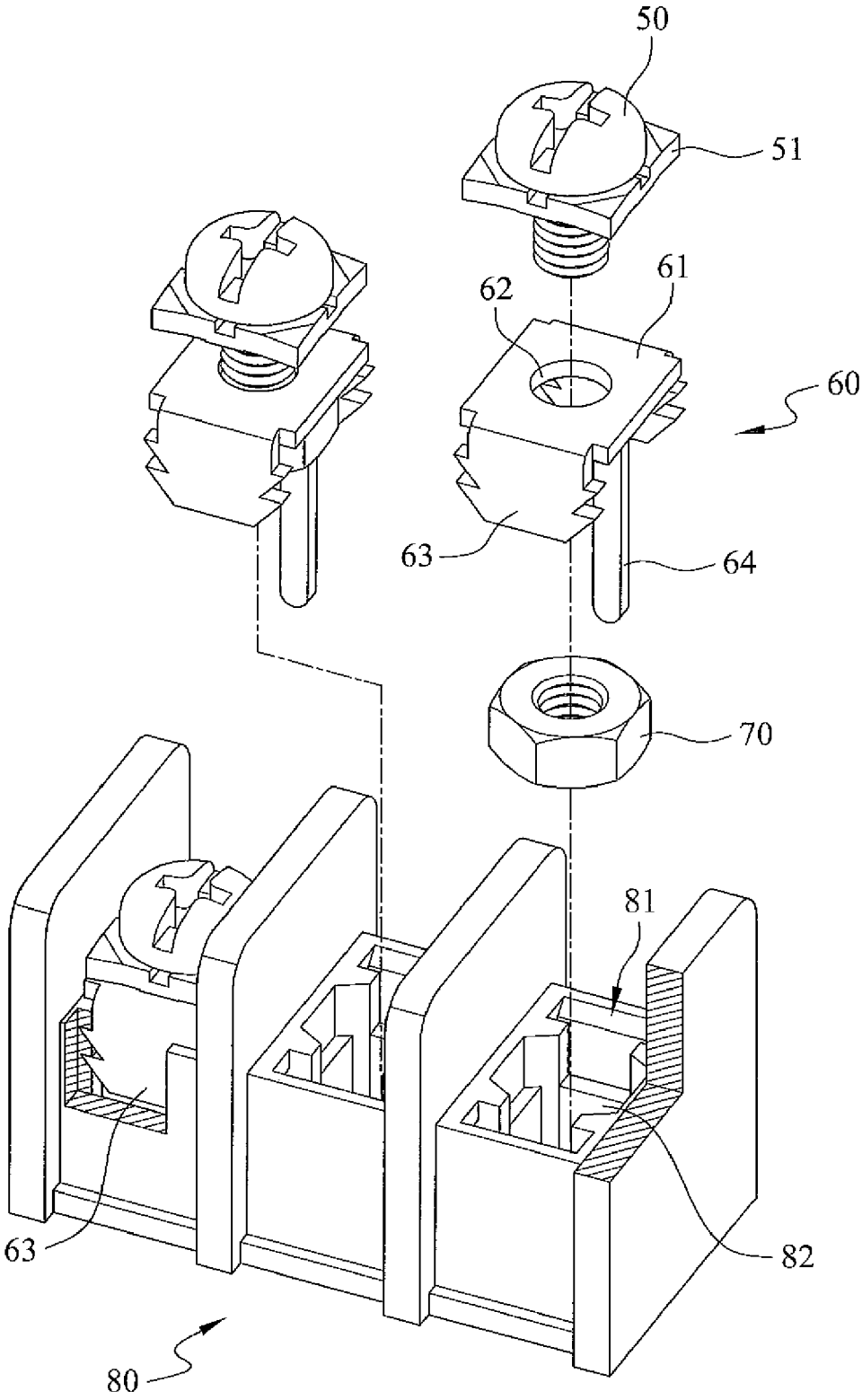
FIG.7 (PRIOR ART)
FIG. 7 is a schematic view of a conventional terminal block structure.
Figure 8:
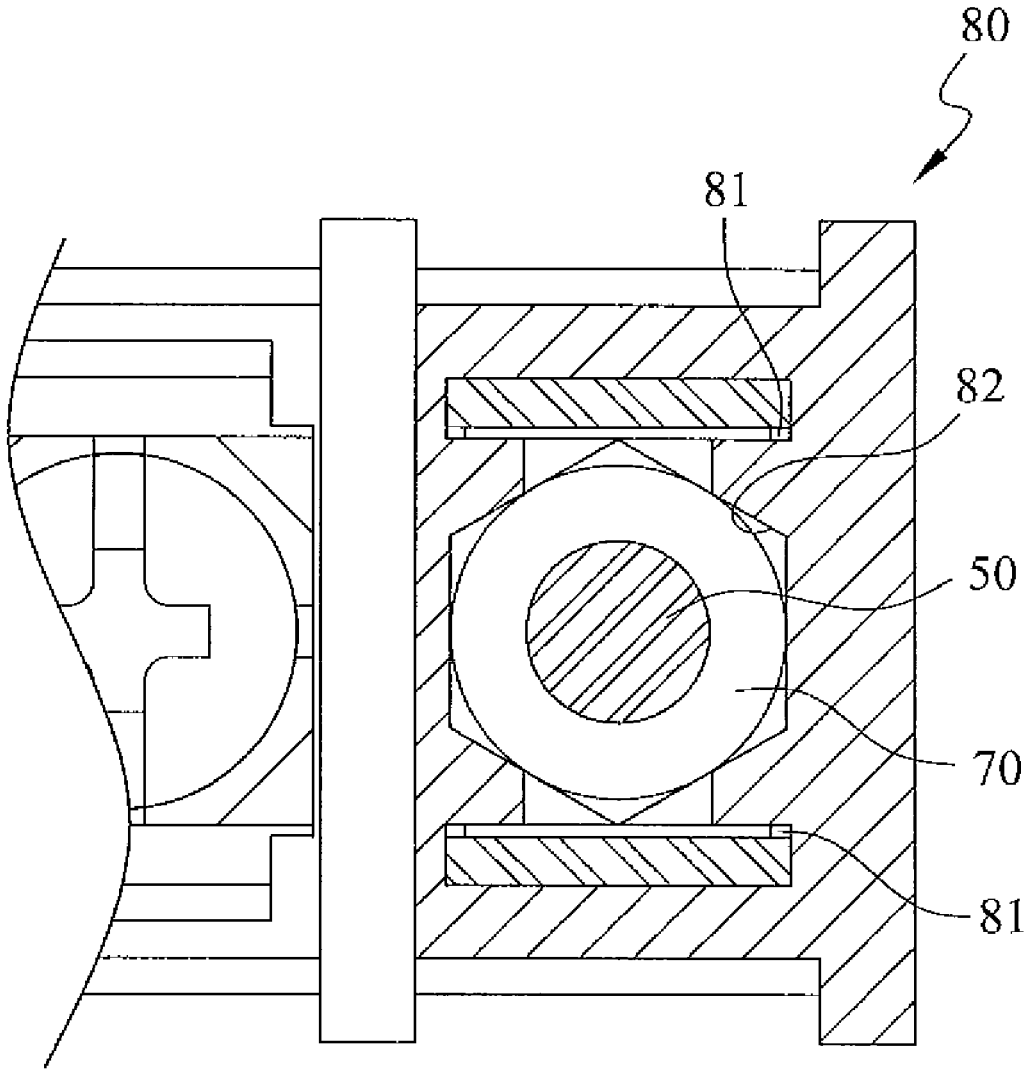
FIG.8 (PRIOR ART)
FIG. 8 is a cross-sectional view of the conventional terminal block structure shown in FIG. 7.
Figure 9:
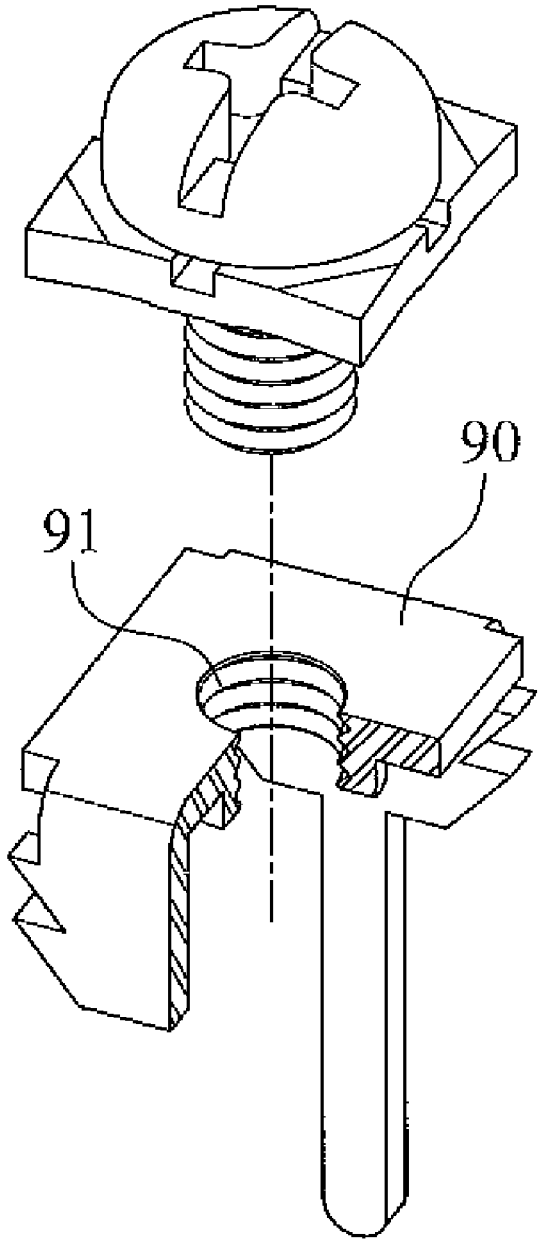
FIG.9 (PRIOR ART)
FIG. 9 is a schematic view of another conventional terminal block structure.

Referring to FIG. 5, in another preferred embodiment of the present invention, the engagement portions 25, 33 of the holder 20 and the inverted U-shaped nut 30 are slot mortise and tenon without departing from the principle of creativity according to the present invention. Referring to FIG. 6, the terminal pin 24 is provided at the end of each of the inserts 23 which flank the holder 20 as needed. Hence, features of the present invention are not subject to a change in the quantity and simple modification of the shape of the terminal pins 24.

In addition, referring to FIG. 1 again, the inserts 23 which flank the holder 20 are provided with the barbs 231, but it is feasible to provide the barbs 231 at the wings 32 which flank the inverted U-shaped nut 30. The above-mentioned are design choices in wide use and therefore are not described in detail herein. Likewise, it is feasible to provide the barbs 231 at the inserts 23 and the wings 32 concurrently, which represents an equivalent substitution and therefore falls within the scope of the present invention.

The present invention is peculiar, novel, and innovative. Any embodiments accomplished by adding a minor structure to the present invention or changing relative positions of mating elements and characterized mostly by the features of the present invention should fall within the scope of the present invention. The disclosures contained in the specification and the drawings of the present invention are only illustrative of the features and functions of the present invention but are not intended to restrict the scope of the present invention. All equivalent modifications and variations made in the foregoing embodiments according to the spirit and principle in the disclosure of the present invention should fall within the scope of the appended claims.

The present invention has advantages, namely, ease of use, structural stability, low cost, industrial applicability, and novelty over published patent applications. Accordingly, the present invention meets the conditions for filing a patent application.

What is claimed is:

1. A terminal block structure, comprising:

a base provided with at least a terminal recess thereon;

a holder disposed inside the terminal recess, having a top surface formed with a platform centrally provided with a through hole, and flanked by two inserts each provided with an engagement portion thereon, wherein one of the inserts is terminally provided with a terminal pin;

an inverted U-shaped nut having a top portion formed with a threaded through hole therein, flanked by two wings each provided with an engagement portion corresponding in position to a corresponding one of the inserts, and disposed beneath the holder, wherein the engagement portions of the inverted U-shaped nut are configured to mate and engage with the engagement portions of the holder so as to prevent rotation thereof; and a fastener having a stud provided with a pad above, wherein the stud is configured to penetrate the holder and the inverted U-shaped nut and thereby enable the holder and the inverted U-shaped nut to be fixed in position.

2. The terminal block structure of claim 1, wherein each of the inserts flanking the holder has a barb.

3. The terminal block structure of claim 1, wherein each of the wings flanking the inverted U-shaped nut has a barb.

4. The terminal block structure of claim 1, wherein the engagement portions of the holder and inverted U-shaped nut are tenons and slot mortises mating mutually.

5. The terminal block structure of claim 1, wherein the inserts flanking the holder are terminally provided with two said terminal pins, respectively.

6. The terminal block structure of claim 1, wherein the fastener is a screw or a bolt.

* * * * *